US006668407B1

(12) United States Patent
Reitzel

(10) Patent No.: US 6,668,407 B1
(45) Date of Patent: Dec. 30, 2003

(54) AUDIO PILLOW WITH SUN SHIELD

(76) Inventor: Rita K Reitzel, 4379 Old Kings Rd., Murrells Inlet, SC (US) 29576

( * ) Notice: Subject to any disclaimer, the term of this patent is extended or adjusted under 35 U.S.C. 154(b) by 0 days.

(21) Appl. No.: 10/106,576

(22) Filed: Mar. 25, 2002

(51) Int. Cl.[7] ..... A47G 9/00; A47C 20/02
(52) U.S. Cl. ..... 5/656; 5/639; 5/640; 5/904
(58) Field of Search ..... 5/656, 636, 639, 5/640, 643, 645, 904, 421, 423

(56) References Cited

U.S. PATENT DOCUMENTS

| | | | | | |
|---|---|---|---|---|---|
| 247,823 | A | * | 10/1881 | Hiller | 5/636 X |
| 2,434,007 | A | * | 1/1948 | O'Dea | 5/640 X |
| 2,932,833 | A | * | 4/1960 | Wambach | 5/656 |
| 2,940,088 | A | * | 6/1960 | Boos | 5/636 |
| 3,946,316 | A | | 3/1976 | Hough | 455/344 |
| 4,100,633 | A | | 7/1978 | Pintos | 5/418 |
| 4,425,675 | A | * | 1/1984 | Victor | 5/636 |
| 4,639,958 | A | * | 2/1987 | Lerner | 5/656 X |
| 4,815,154 | A | * | 3/1989 | Grimes | 5/656 X |
| 4,862,438 | A | | 8/1989 | Fry | 369/19 |
| 4,865,380 | A | * | 9/1989 | Heitzman-Powell et al. | 297/184.13 |
| 5,033,528 | A | * | 7/1991 | Volcani | 160/351 |
| 5,076,405 | A | | 12/1991 | Modica | 190/1 |
| 5,123,133 | A | | 6/1992 | Albert | 5/639 |
| 5,179,747 | A | * | 1/1993 | Zink | 5/639 |
| 5,201,002 | A | | 4/1993 | Dahlem | 381/301 |
| 5,345,633 | A | * | 9/1994 | Harnish | 5/645 X |
| 5,397,268 | A | * | 3/1995 | Chang et al. | 454/338 |
| 5,515,564 | A | | 5/1996 | Lyons | 5/639 |
| 5,713,741 | A | * | 2/1998 | DeMars | 5/639 X |
| 5,727,841 | A | | 3/1998 | Morley | 297/188.06 |
| 5,737,787 | A | | 4/1998 | Iozef | 5/639 |
| 5,806,118 | A | * | 9/1998 | Lerner | 5/639 |
| 5,819,346 | A | | 10/1998 | Lane | 5/639 |
| 6,044,161 | A | | 3/2000 | Lee | 381/301 |
| 6,098,220 | A | * | 8/2000 | Momma | 5/636 |
| 6,173,725 | B1 | * | 1/2001 | Garth | 135/87 |
| 6,236,621 | B1 | * | 5/2001 | Schettino | 5/639 X |
| 6,484,335 | B2 | * | 11/2002 | Gilbert | 5/636 |
| 2001/0049844 | A1 | * | 12/2001 | Gilbert | 5/636 |

* cited by examiner

*Primary Examiner*—Robert G. Santos
(74) *Attorney, Agent, or Firm*—Michael I. Kroll

(57) ABSTRACT

The present invention 10 discloses a sun visor or canopy 20 attached by an extendable/flexible means 34 to a pillow 40 shaped to comfortably receive the head of a user 12. The pillow 40 comprises a main enclosure 36 having a protective cover 56 thereon for protection from the elements. The main enclosure houses a radio 46 having volume 42 and station selector 44 and a battery power source 54 for providing music to the user 12 as the user 12 uses the present invention 10. The extendable/flexible element 34 allows the canopy 20 to be adjustably moved about. Hooks 32 are provided on the present invention in order to attach it to the back 24 of a lawn chair 22.

16 Claims, 8 Drawing Sheets

AUDIO PILLOW WITH SUN SHIELD

BACKGROUND OF THE INVENTION

1. Field of the Invention

The present invention relates generally to a visor and, more specifically, to blocking and/ or shielding sunlight or any unwanted light from the faces and eyes. The present invention is a visor having a selectively tunable radio therein, with a headrest and visor positioning means. The present visor invention consist of a canopy element, a extendable and flexible element, a retaining aperture, a selectively tunable radio (with a shielded antenna), a main enclosure, a cover element, a plurality of Velcro contacts, an end cap, chair mounting brackets, bracket retainers, a selectively closed circuit system, and a battery well with a battery access panel. The canopy element is a rectangular shaped structure that provides the present visor invention with its shading and overcasting properties. The canopy element is located at the apex of the visor invention to provide the means for maximizing the canopy element's shading quality. The canopy element is affixed to an extendable and flexible element, which is in turn affixed to the main enclosure of the visor invention. The extendable and flexible element provides the means for the canopy element to be selectively positioned and cast a shadow in a limited yet selectively reasonable range. The extendable and flexible element is a cylindrical shaped curvilinear structure that provides the visor invention with the means for selectively positioning its canopy element along a predetermined vertical or horizontal trajectory. The extendable and flexible element is affixed to the canopy element at one of its distal ends, and is further affixed to the main enclosure via retaining means at its other distal end. The extendable and flexible element is retained in its selective position via the flexible aspect. The extendable and flexible element provides the canopy element of the visor invention with the means for pivoting a radial trajectory of a hundred and eighty degrees (180 E). The main enclosure is a molded structure that provides housing for the radio, the speakers and other components of said visor invention while providing support for the pivoting element, the extendable element as well as the canopy element. Also the main enclosure along with the cover element provides the head rest aspect of said visor invention. The cover element is an insulated material that provides housing and outer protection for the main enclosure. Also the cover element provides the individual user with the means of a cushioned headrest. The cover element is adorned with a plurality of accessible compartments having selective retaining Velcro contacts that provides the means for selectively retaining and/or the selective manipulation of the internal components of said visor invention. The chair mounting brackets are hooked shaped structures that are selectively affixed to the main enclosure of the visor invention and provide the visor invention with the means for the temporary attachment to a lawn or patio chair. The battery well is a hollowed cavity in the main enclosure that provides housing means for the dry cell units which give power to the radio therein the visor invention. The battery access panel provides the selective locking and retaining means for the dry cell units in the battery well. The selectively closed circuit system consists of a selectively tunable radio, an on switch, electrical contacts, audio speakers and a shielded antenna. The selectively closed circuit and all it parts are housed in the main enclosure and provides the means for the individual user to operate the radio and enjoy the audible aspect the visor invention. The radio of said visor invention is to have the same or improved aspects and functions of a conventional radio and/ or music player.

2. Description of the Prior Art

There are other visor device designed for shielding an individual from unwanted sun light as well as other unwanted light sources. Typical of these is U.S. Pat. No. 4,100,633 issued to Pintos on Jul. 18, 1978.

Another patent was issued to Fry on Aug. 29, 1989 as U.S. Pat. No. 4,862,438. Yet another U.S. Pat. No. 5,076,405 was issued to Modica on Dec. 32, 1991 and still yet another was issued on Jun. 23, 1992 to Albert as U.S. Pat. No. 5,123,133.

Another patent was issued to Zink on Jan. 19, 1993 as U.S. Pat. No. 5,179,747 and still yet another U.S. Pat. No. 5,201,002 was issued to Dahlem on Apr. 6, 1993. Yet another was issued on Mar. 14, 1996 to Lyons as U.S. Pat. No. 5,515,564. Another was issued to Morley on Mar. 17, 1998 as U.S. Pat. No. 5,727,841 and still yet another was issued on Mar. 24, 1998 to Baousson as U.S. Pat. No. Des 392,495. Another patent was issued to lozef on Apr. 14, 1998 as U.S. Pat. No. 5,737,787. Yet another U.S. Pat. No. 6,044,161 was issued to Lee on Mar. 28, 2000.

U.S. Pat. No. 4,100,633

Inventor: Pintos

Issued: Jul. 18, 1978

A combination sun screen and pillow for use at the beach, by a swimming pool, or the like. The basic device comprises a pillow, a sunscreen, and means mounting the sunscreen on the pillow such that, during use of the device, the sunscreen shades the face of a person resting his head on the pillow. The mounting means comprises a telescopically extensible rod which is pivotably mounted at one end to the pillow and at the other end to the sun screen, and means are provided on the sun screen for holding a book open and in place on the side of the sun screen adjacent to the pillow. The radio is mounted in or on the pillow, and the pillow contains a closable compartment for the retention of the personal belongings of the person using the device.

U.S. Pat. No. 4,862,438

Inventor: Fry

Issued: Aug. 29, 1989

A pillow/audio system combination functioning as both a pillow and an audio system. A substantially rectangularly-shaped pillow casing has stuffing material therein. An audio signal generating device such as a tape recorder is provided within the pillow casing along with a speaker and a battery for providing audible sound. Switches are provided at the corners of the pillow and are connected to the signal generating device for energizing and deenergizing the same. A battery jack is provided on the pillow casing for recharging the batteries therein. An audio jack is also provided on the pillow casing for connecting to a piggyback pillow having therein a speaker, which also generates audible sound via the signal received through the audio jack and an audio extension cord. A pocket is provided within the pillow casing for housing the various components of the audio system.

U.S. Pat. No. 5,076,405

Inventor: Modica

Issued: Dec. 31, 1991

A beach accessory includes a carrying case having a plurality of storage compartments, a flexible mat stored within one of the storage compartments and extendable through a side of the carrying case, and a cushion pivotally attached to the carrying case. The cushion is connected to the carrying case by a pair of hinges to be rotatable between a first position wherein the cushion lies atop an upper surface of the carrying case, and a second position wherein the cushion rests, at least partially, on or adjacent to a ground surface. In the first position the cushion provides a cover for the storage compartments and a seat for a user of the beach accessory. In the second position a cushion provides a pillow for a person lying upon the mat after it has been extended from the carrying case. The carrying case is configured to provide a portable table when inverted, and includes an alarm clock, a radio receiver and a cassette tape player.

U.S. Pat. No. 5,123,133

Inventor: Albert

Issued: Jun. 23, 1992

A pillow comprises a horizontally extending body for supporting the head of a user of the pillow. The pillow also comprises a pair of leg members which extend transversely at opposite lateral ends of the body and downwardly from a lower surface thereof, thereby defining a space between the leg members and under the body. A pair of speakers is positioned in the body each at least partly above a respective leg member and in a way so that sound emitted thereby is directed substantially vertically when no load is applied on the pillow. The body being made of a flexible material, the resting of the user's head on an upper central portion of the body causes this central portion to deflect downwards with the leg members and the end portions of the body pivoting upwards and inwards in such a way that the speaker pivots with the body so that sound emitting therefrom is directed at an angle upwards and inwards towards the user's ears.

U.S. Pat. No. 5,179,747

Inventor: Zink

Issued: Jan. 19, 1993

A pillow including a top and bottom fibrous web defining a casing includes a radio mounted within the casing cooperating with a remotely located speaker. The pillow further includes the speaker mounted within a speaker housing, including fluid filled walls, and where the housing cavity includes compressible fluid capsules to accommodate impact to the speaker unit. The pillow structure may further be provided with a serpentine pneumatic chamber filled with further compressible fluid capsules to afford comfort and cushioning to a user, as well as components of the radio-clock system.

U.S. Pat. No. 5,201,002

Inventor: Dahlem

Issued: Apr. 6, 1993

The disclosed stereo sound pillow has a resilient interior fibrous composite and an essentially nonextendable exterior case completely enclosing the interior composite. Sound speakers having sound outlets from both front and rear sides thereof, and lead wires connected to each speaker, are fixed to a flexible mounting strip: and the mounting strip and speakers are surrounded by the interior composite to hold the sound speakers suspended within the interior composite, spaced apart lengthwise and from the side and end edges thereof, and the lead wires exit from the exterior case adjacent one end edge. The mounting strip allows the fast and economical fabrication of the pillow, either: as the interior composite is formed by rolling up a web of the fibrous material on itself and over the mounting strip and speakers, or after the interior composite is fitted inside of the exterior case by parting the interior composite and inserting the mounting strip and speakers into the defined cavity in the composite interior and then collapsing the cavity. The mounting strip may be made from the same material used for the resilient interior fibrous composite.

U.S. Pat. No. 5,515,564

Inventor: Lyons

Issued: May 14, 1996

The present invention is a sun shield which can be easily attached and/or detached from most standard sized beach chairs. In another embodiment, the sun shield is attached to a frame which has a bag stretched around the frame to provide a carrying case for beach items as well as a comfortable pillow for the user to rest his/her head upon. Additionally, the sun shield may fold up to act as a handle, and to facilitate carrying that bag. In yet another embodiment of the invention, the sun shield is attached to a cooler which is designed to carry items in a cooling environment to or from the beach and/or the pool side. It also provides the user with a comfortable headrest to rest his or her head upon while sunbathing.

U.S. Pat. No. 5,727,842

Inventor: Morley

Issued: Mar. 17, 1998

A lounge chair accessory is removably mounted to the back of the chair. The accessory includes a front surface adjacent to the body of a user seated within the chair for providing a pillow and back cushion, and a rear surface extending rearwardly from the chair providing storage compartments for storing various items including cold beverages. The accessory is foldable into a compact unit when removed from the back of the lounge chair, and straps are provided for carrying the compact unit either by hand or as a backpack. In the alternative, the accessory can remain mounted to the chair when the chair is folded, and both the chair and the accessory can be carried as a single unit. The front surface of the accessory can be pivoted relative to the back of the lounge chair to provide a sun cover over the head of the user instead of employing the front surface of the accessory as a pillow or as a back cushion.

U.S. Pat. No. 5,737,787

Inventor: lozef

Issued: Apr. 14, 1998

The present invention relates to pillow radio apparatus which comprises an ordinary pillow substantially covered by one or two sensors extending below the pressing element, e.g. the head of the child, on one or both sides of the pillow, said sensor being able to sense the force of the pressing element; the apparatus being located within a pillow case and being connected via actuating means to a receiver, the apparatus being also connected to at least one power supply unit.

The sensor may be a capacity sensor; one or two webs being located at a suitable place and comprising a conductive net; or a bag comprising air or a fluid.

The actuating means is, for example, an electronic circuit comprising a frequency oscillator; a unit which switches the oscillator on periodically; and a unit which switches the receiver on and off, which consists of a key and an optoisolator.

The pillow case advantageously comprises the story to be told.

U.S. Pat. No. Des. 392,495

Inventor: Baousson

Issued: Mar. 24, 1998

The ornamental design for an inflatable beach pillow or cushion, as shown and described.

U.S. Pat. No. 6,044,161

Inventor: Lee

Issued: Mar. 28, 2000

The invention is a pillow speaker for use as a combination headrest and sound delivery system for transmitting sounds, including music to a person's head. The pillow speaker comprises a pillow headrest having an upper surface for receiving and supporting a person's head. Extending downward from the upper surface is a lower body portion. The lower body portion is adapted for support from an exterior stable surface, the pillow speaker being constructed from a homogeneous flexible material. A pair of spaced apart loud speakers are mounted through the upper surface, within the lower body portion. The loud speakers include an exterior face for projecting sound outward from the pillow speaker, and an opposing rear face for projecting sound into and through the lower body portion. Importantly, the lower body portion of the pillow speaker comprises a plurality of large voids through which sound waves from the loud speakers can travel upwardly through the upper surface thereby reaching the listener from many directions.

While these visor and canopies may be suitable for the purposes for which they were designed, they would not be as suitable for the purposes of the present invention, as hereinafter described.

SUMMARY OF THE PRESENT INVENTION

The present invention discloses a sun visor or canopy attached by an adjustable, extendable/flexible means to a pillow shaped to comfortably receive the head of a user. The pillow comprises a main enclosure having a protective cover thereon for protection from the elements. The main enclosure houses a radio having a volume and station selector and a battery power source for providing music to the user as the user uses the present invention. The extendable/flexible element allows the canopy to be adjustably moved about. Hooks are provided on the present invention in order to attach it to the back of a lawn chair.

A primary object of the present invention is to provide a visor invention that may blocks unwanted light form the face and eyes of the user.

Another object of the present invention is to provide a visor invention that houses a radio with speakers that may produce an audible melody for entertainment purposes.

Yet another object of the present invention is to provide a visor invention having a head rest that may promote back and neck support.

Still yet another object of the present invention is to provide a visor invention that may have a selectively adjustable canopy.

Yet another object of the present invention is to provide a visor invention that may be affixed to a plurality of lawn, garden or patio furniture, without hindering the reclining range of the lawn/patio furniture or the selectively adjustable canopy of said visor invention.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
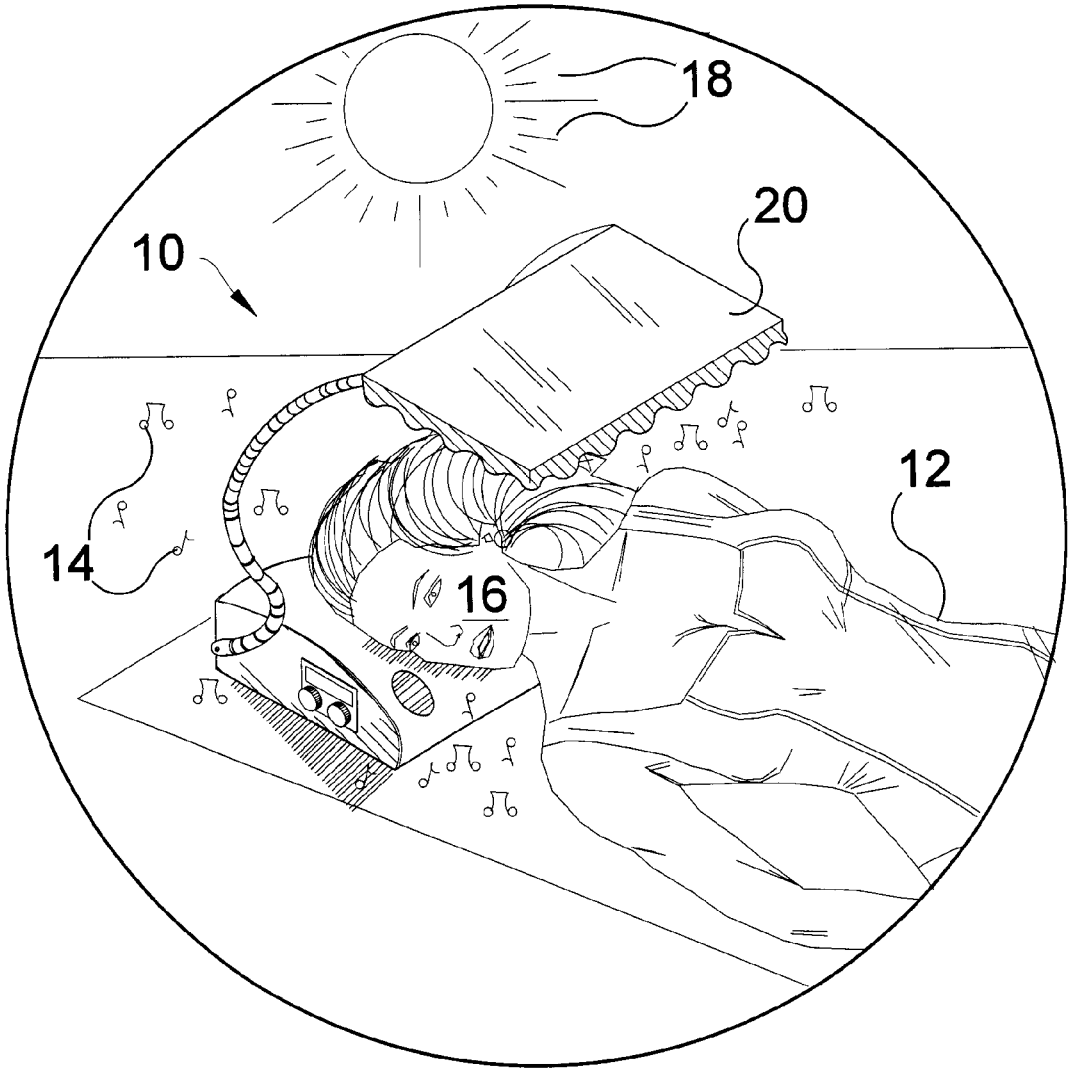
FIG. 1 is a perspective view of the present invention. Shown is a female enjoying the melodies being played by said visor invention as her face and upper torso is shielded from the sun rays by the canopy element of said visor invention. Also shown is the overall functional aspect of said visor invention.

With regard to reference numerals used, the following numbering is used throughout the drawings.

10 present invention
12 user
14 notes
16 head
18 sun rays
20 canopy
22 lawn chair
24 back rest
26 upright position
28 reclined position
30 arrows
32 hooks
33 attachment means
34 flexible/extendable element
36 main enclosure
38 speaker recesses
40 pillow
42 volume control
44 station selector
46 radio
48 fan
50 strap means
52 access panel
54 batteries
56 cover material
58 battery well
60 terri-cloth flap
62 audio speaker
64 radio cutout
66 aperture
67 base frame
68 dirt and sand cover
70 radio enclosure
72 speaker enclosure
74 wire conduit
76 end cap
78 antenna
80 attachment means

DESCRIPTION OF THE PREFERRED EMBODIMENT(S)

In order that the invention may be more fully understood, it will now be described, by way of example, with reference to the accompanying drawings in which FIGS. 1 through 8 illustrate the present invention being an audio pillow having a sun shield thereon.

Turning to FIG. 1, shown therein is a perspective view of the present invention 10. Shown is a female user 12 enjoying the melodies indicated by notes 14 being played by the present invention 10 as her head 16 and upper torso is shielded from the sun rays 18 by the canopy element 20 of the present invention. Also shown is an overall view of the present invention.

Figure 2:
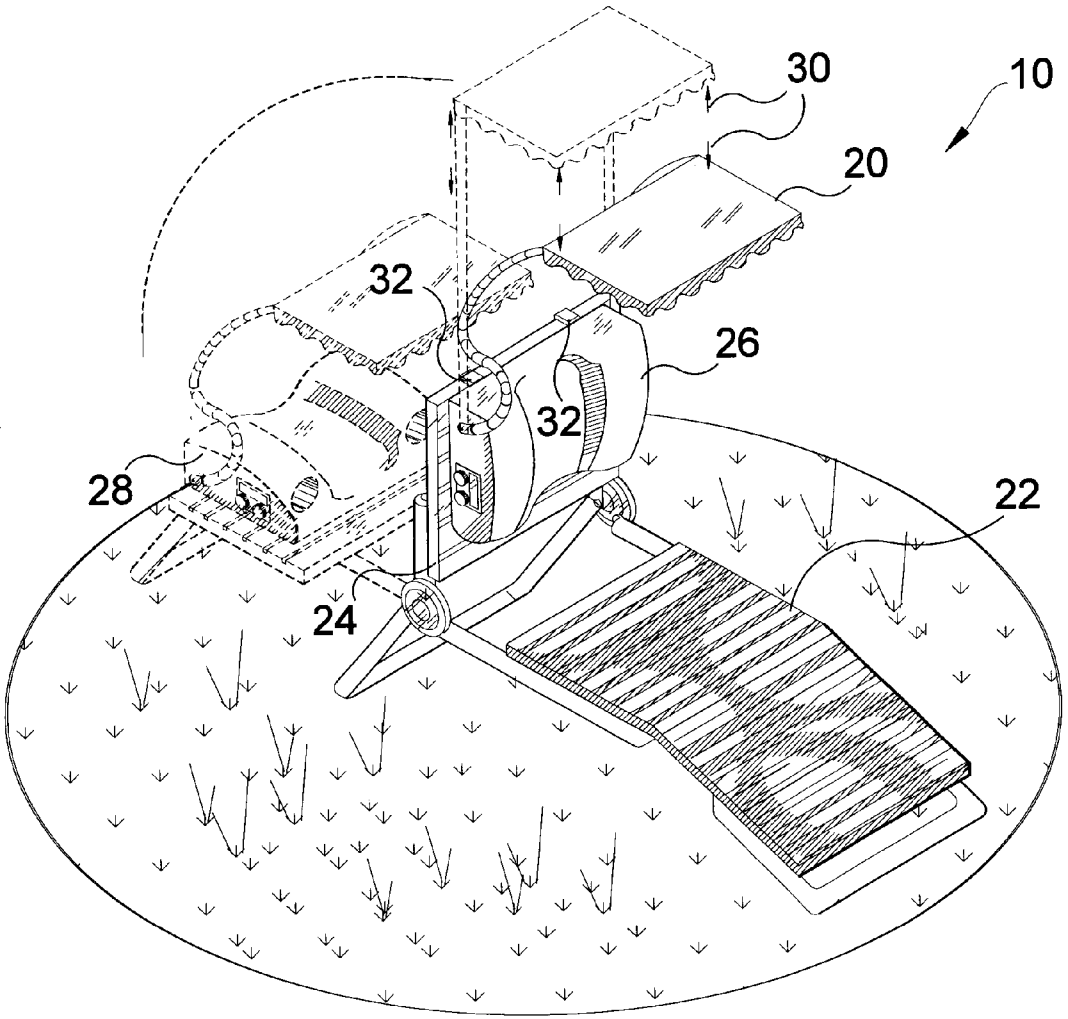
FIG. 2 is a perspective view, showing a lawn/patio chair having said visor invention affixed temporarily to its back rest. Also shown is the visor inventions as it is Affixed to a lawn chair with the lawn chair positioned in its upright mode and in phantom lines its total reclined modes. Shown is the canopy element of said invention in phantom lines being extended upwards (shown by vertical arrows) to clear for head room of an individual or to best maximize its shade casting function.

Turning to FIG. 2, shown therein is a perspective view showing a lawn/patio chair 22 having the present invention 10 affixed temporarily to its back rest 24. Shown is the present invention as it is affixed to a lawn chair with the lawn chair positioned in its upright mode or position 26 and in phantom lines its total reclined mode or position 28. Shown is the canopy element 20 of the present invention in phantom lines being extended upwards (shown by vertical arrows 30) to clear for head room of an individual or to best maximize its shade casting function. Hooks 32 are shown for attaching the present invention 10 to the back 24 of a lawn chair 22.

Figure 3:
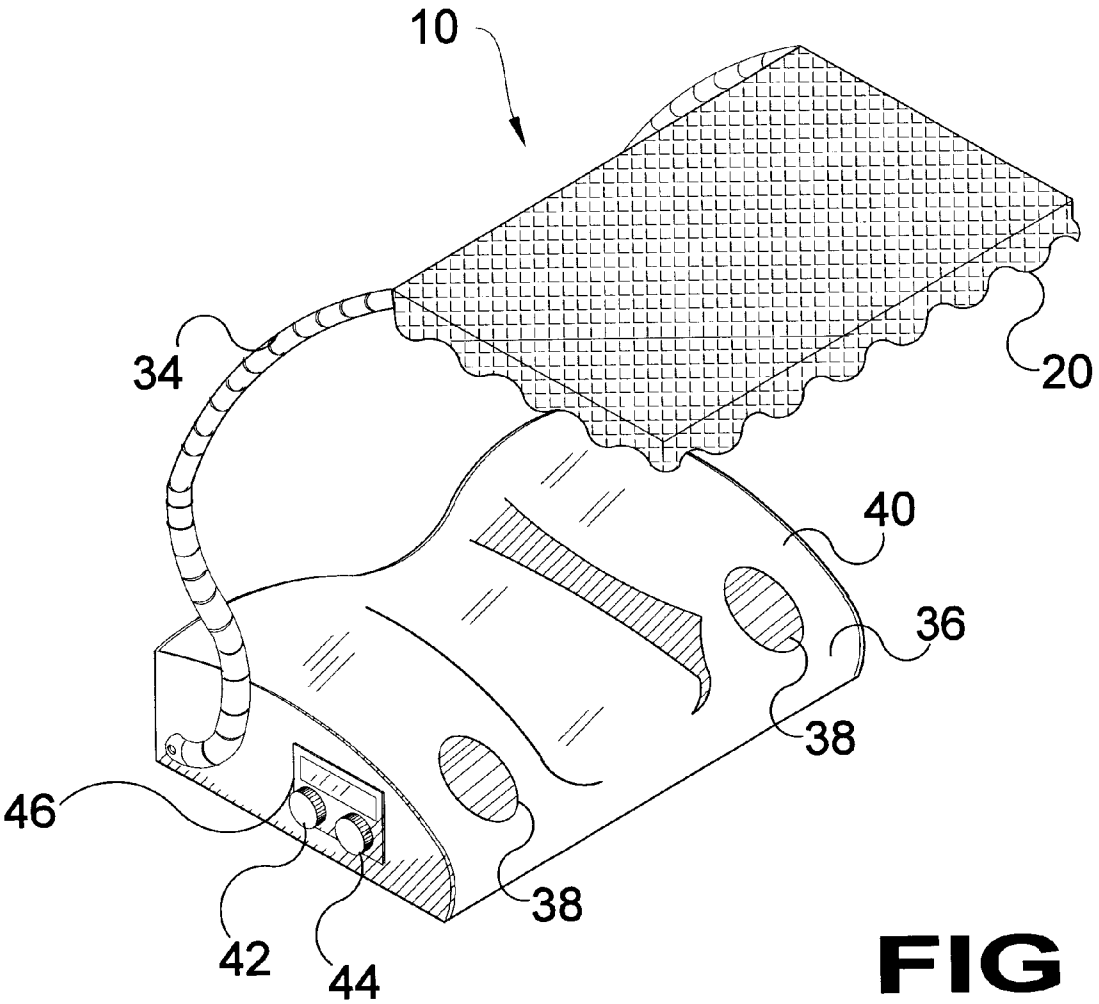
FIG. 3 is a perspective view, showing several of intricate components that comprise said visor invention. Also shown is the displacement relations of several intricate components of the visor invention as they relate to each other. Shown also shown is the canopy element as it is affixed to the extendable element, which in turn is coupled to the main enclosure. Shown also are retaining recesses located on the left side (present view) of said visor invention. Also shown is the ideal shape of said visor invention as it seems fit to accommodate its overall functions. Shown also is the ideal displacement relations of the audio speakers as they relate to said visor invention in order to provide the individual user with best listening qualities.

Turning to FIG. 3, shown therein is a perspective view showing several of intricate components that comprise the present invention 10. Shown also is the canopy element 20 as it is affixed to the flexible and adjustable extendable element 34, which in turn is coupled to the main enclosure 36. Shown also are audio speaker retaining recesses 38. Also shown is the upwardly concave pillow 40 having an ideal shape of the present invention for comfortably receiving the head of the user. Shown also is the ideal displacement relations of the audio speakers 38 as they relate to the present invention in order to provide the individual user with best listening qualities. Also shown are the volume control 42 and station selector 44 knobs of the radio 46.

Figure 4:
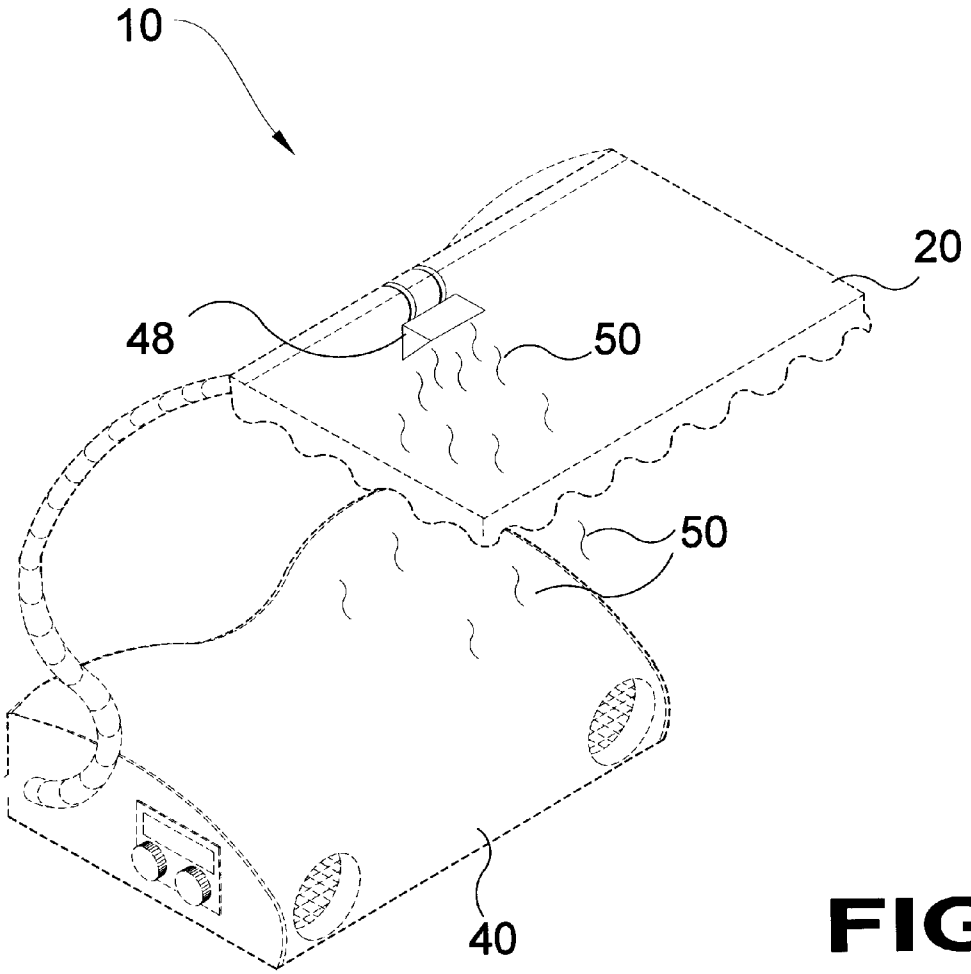
FIG. 4 is a perspective view, showing said visor invention in phantom lines. Also shown is a fan device affixed to the rear of the canopy element. Shown is the displacement as well as functional relations of the fan device as it relates to said visor invention. Shown also is the fan device as it radiates a stream of air on to the head rest of said visor invention.

Turning to FIG. 4, shown therein is a perspective view showing the present invention 10 in phantom lines. Also shown is a fan device 48 affixed with a strap means 50 to the rear of the canopy element 20. Shown is the displacement as well as functional relations of the fan 48 device as it relates to the present invention. Shown also is the fan device 48 as it radiates a stream of air 50 onto the pillow 40 of the present invention.

Figure 5:
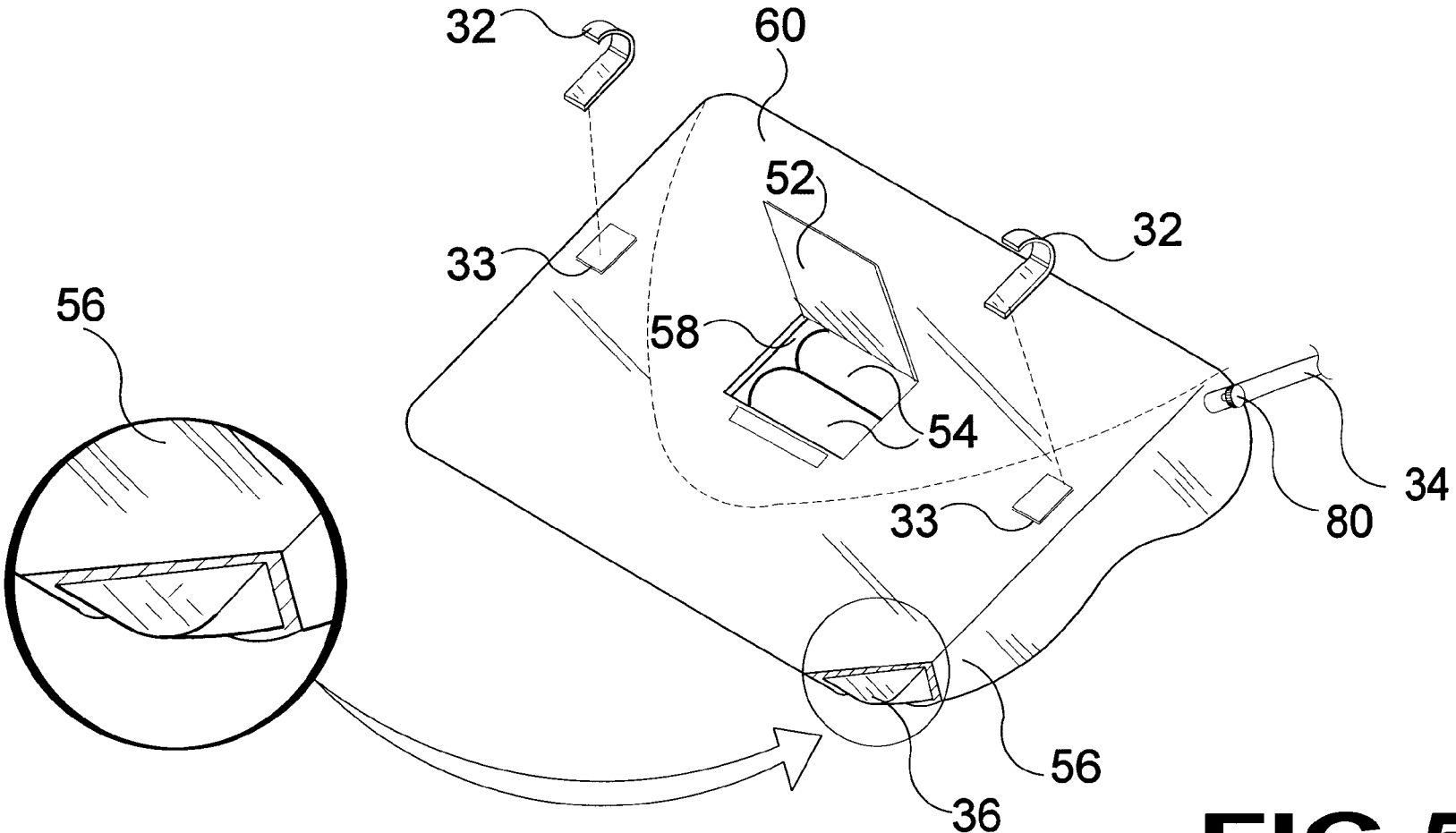
FIG. 5 is a perspective view, showing displacement as well as functional relations between several intricate components and parts that comprise said visor invention. Shown in exploded view are the chair mounting brackets as their affixing means. Also shown is the battery access panel in exploded view showing its seating and positioning relations. Shown also in ballooned call out is the gauging of the insulated cover material as it covers the main enclosure of said visor invention. Also shown is the selectively accessible battery compartment in the opened position revealing the dry cell units. Shown also are the dry cell units as they are seated and positioned in the battery well of said visor invention.

Turning to FIG. 5, shown therein is a bottom perspective view showing displacement as well as functional relations between several intricate components and parts that comprise the present invention. Shown in exploded view are the chair mounting brackets 32 and their attachment means 33 which may be hook and loop or adhesive material. Also shown is the battery 54 access panel 52 in exploded view showing its seating and positioning relations. Shown also in ballooned call out is the gauging of the insulated cover element, or material 56 as it covers the main enclosure 36 of the present invention. Also shown is the selectively accessible battery compartment 58 in the opened position revealing the dry cell units 54. Shown also are the dry cell units 54 as they are seated and positioned in the battery well 58. A terri-cloth flap 60 is also shown along with attachment means 80 for attaching extendable element 34 to main enclosure 36.

Figure 6:
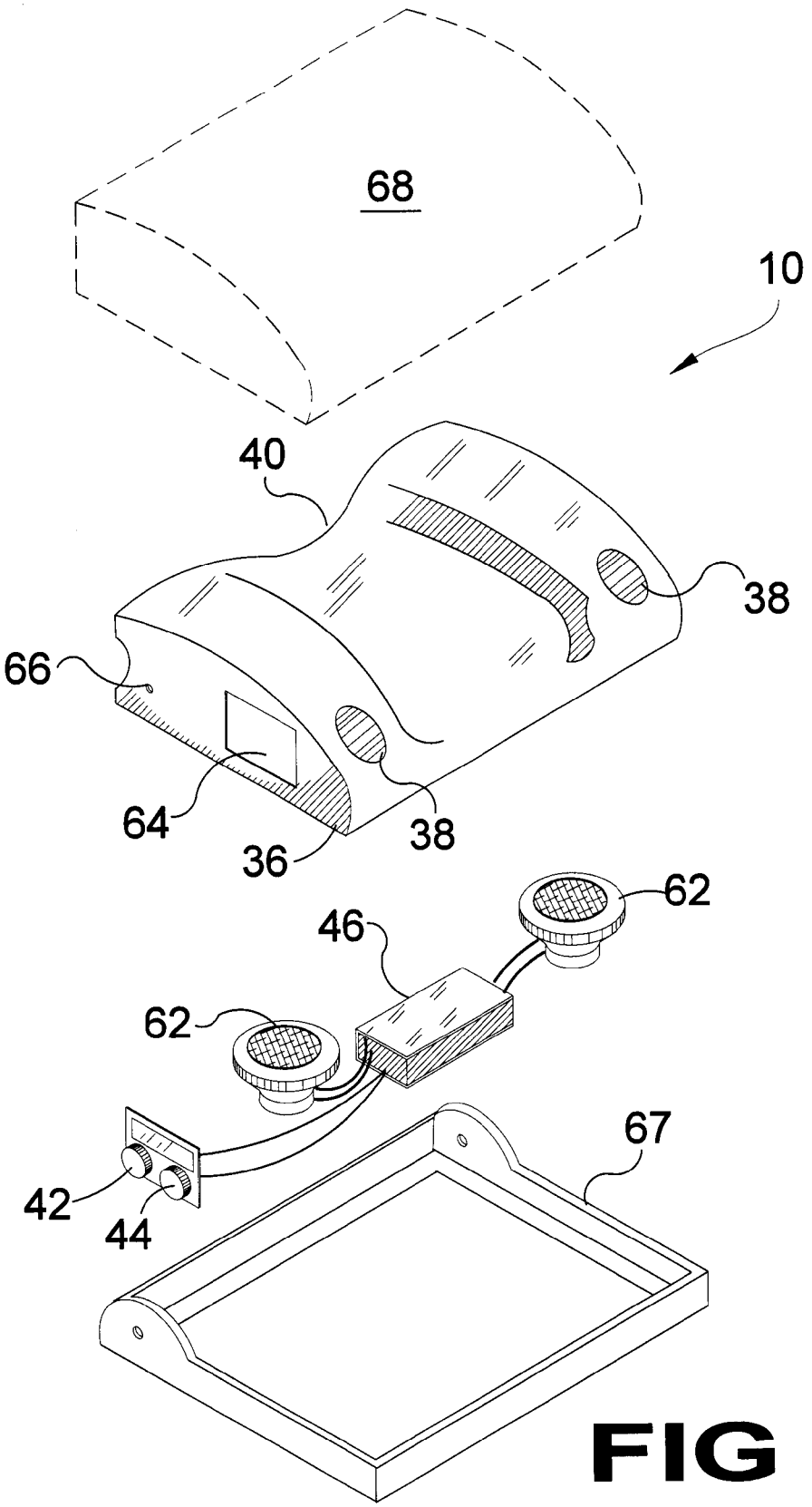
FIG. 6 is a perspective view, showing is the main enclosure of said visor invention. Also shown are two apertures located in the front (as viewed) of the main enclosure, these apertures are to house the audible speakers of the visor invention. Shown also is a volume/select cut out this is a square shaped aperture that houses the user interface portion of a conventional radio. Also shown is the ideal shape of said visor invention as it seem fit to insure proper head positioning and back support when using said visor invention.

Turning to FIG. 6, shown therein is a perspective view showing the main enclosure 36 of the present invention 10. Also shown are two apertures 38 located in the front (as viewed) of the main enclosure which house the audio speakers 62 of the present invention. Shown also is a volume/select cut out 64 which is a square shaped aperture that houses the user interface portion 42, 44 of a conventional radio 46. Also shown is the ideal shape of the present invention as is proper to fit to the user to insure proper head positioning and back support when using the present invention. Also shown is a base frame 67, pillow 40 made of preformed foam, radio 46, and an aperture 66 for receiving the extendable element and a dirt and sand cover 68.

Figure 7:
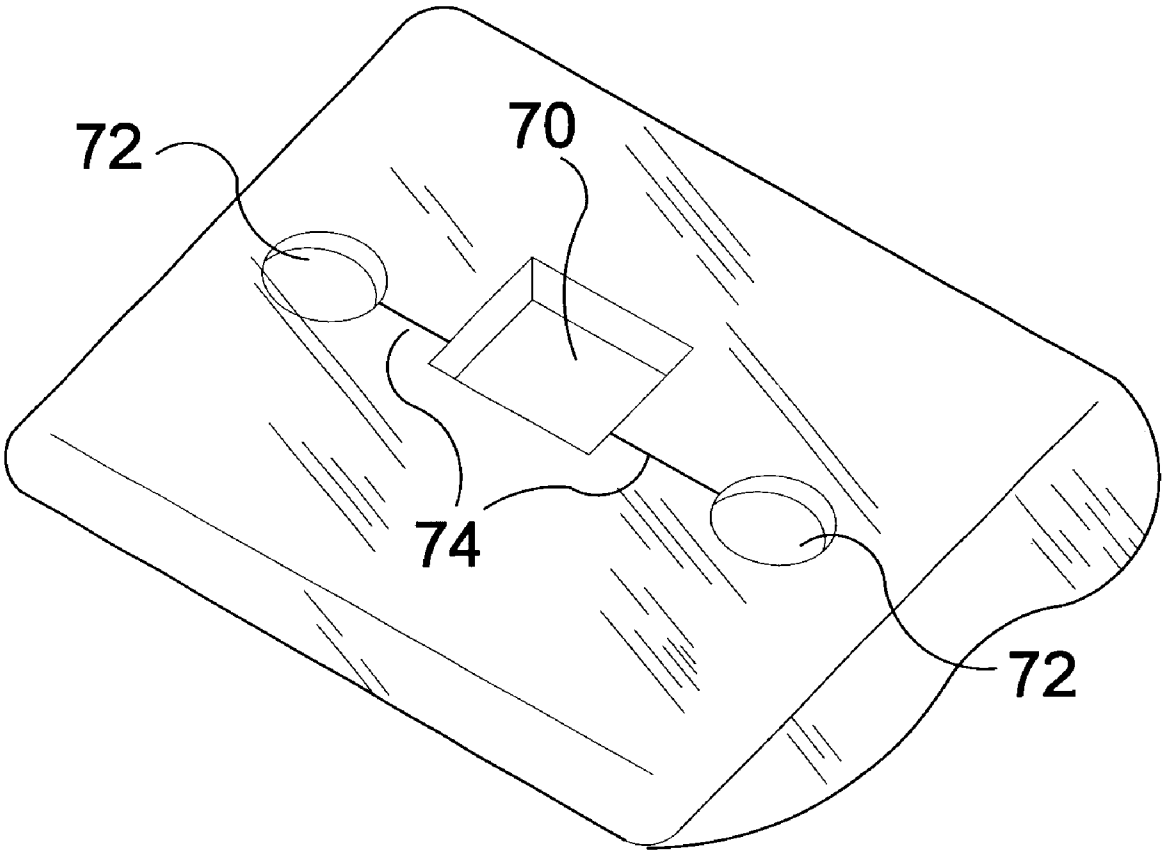
FIG. 7 is a perspective view, showing the various types of selectively accessible compartments allotted to said visor inventions. Also shown are the chair mounting brackets selectively affixed to the cover element as it covers the main enclosure. Shown also are the displacement relations of a plurality of Velcro contacts as they are affixed to the cover elements accessible compartments. Also shown is the battery access compartment in its opened position revealing the battery access panel. Shown also is the cover element accessible compartment (cover flap) in the opened position showing unlimited accessibility to the main enclosure without removing the cover element of said visor invention.

Turning to FIG. 7, shown therein is a perspective view showing the various types of selectively accessible compartments allotted to the present invention. Shown is the radio enclosure 70, two speaker enclosures 72 and wire conduit 74.

Figure 8:
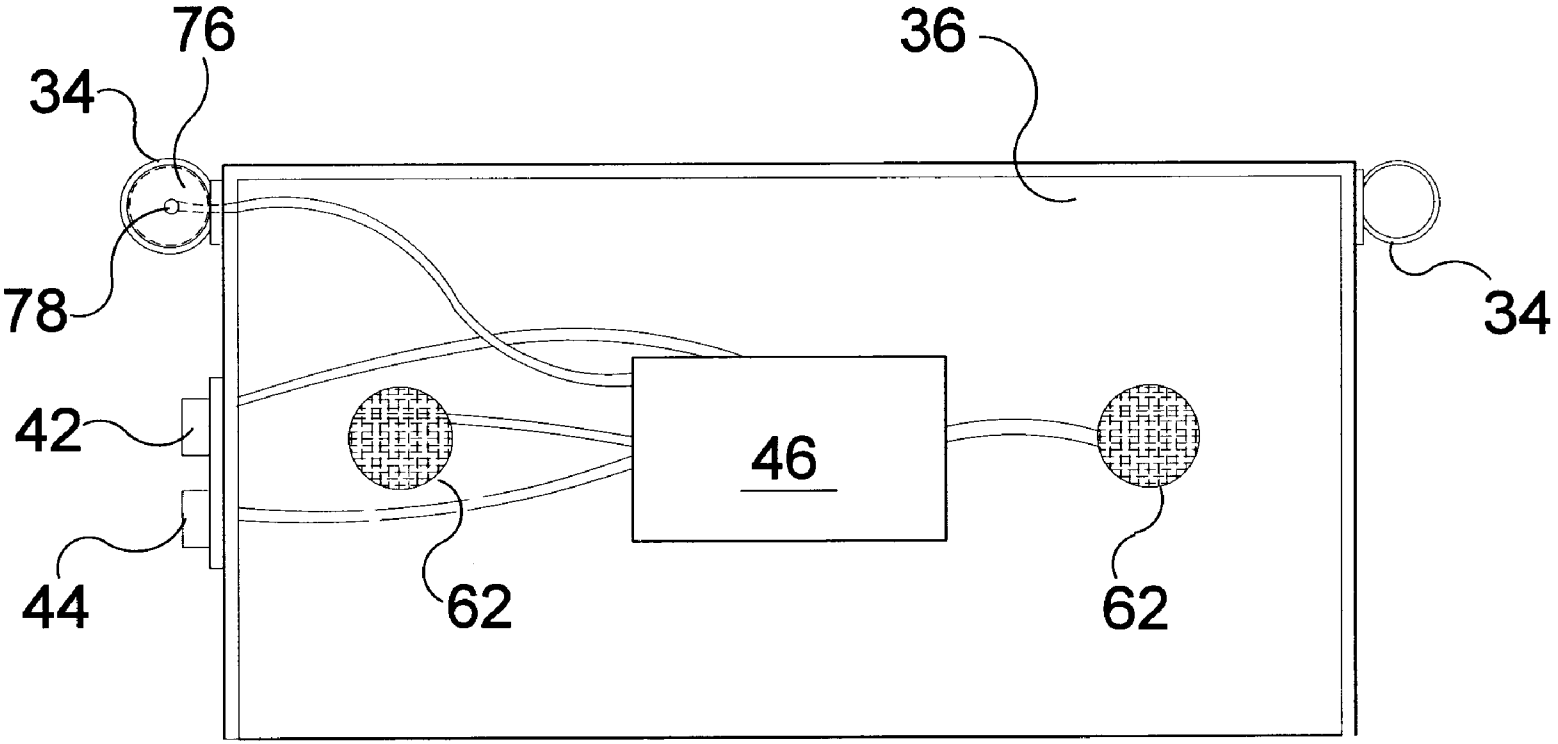
FIG. 8 is a sectional view, showing the electrical contacts of the selectively closed circuit system. Also shown is the positioning relations of the intricate components that are housed in the main enclosure. Also shown are the audio speaker as they relate to the: selectively closed circuit system of said visor invention. Shown also are the volume and selector control for the radio, these controls are present in any conventional radio device, i.e., (digital, transistor, analog). Also shown is an end cap affixed to one of the pivoting elements, the endcap protects the antenna from any inadvertent contact with hazardous elements.

Turning to FIG. 8, shown therein is a sectional view showing the electrical contacts of the selectively closed circuit system. Also shown is the positioning relations of the intricate components that are housed in the main enclosure 36. Also shown are the audio speaker 62 as they relate to the selectively closed circuit system of the present invention. Shown also are the volume 42 and selector control 44 for the radio 46, these controls being present in any conventional radio device, i.e., (digital, transistor, analog). Also shown is an end cap 76 affixed to one of the pivoting elements 34 wherein the endcap protects the antenna 78 from any inadvertent contact with hazardous elements.

I claim:

1. An apparatuss for a head rest having a sun visor thereon, comprising:

a) a base frame for supporting the apparatus, said base frame being generally rectangular in shape;

b) a main enclosure disposed on said base frame for enclosing parts of the apparatus, said main enclosure having a plurality of apertures therein;

c) wherein said main enclosure further comprises a pillow head rest shaped to comfortably receive a head of a user, said head rest being upwardly concave to receive a head of a user;

d) means for a sun visor adjustably disposed on said main enclosure comprising a generally planar canopy;

e) means for an audio module disposed internal said main enclosure;

f) an adjustable arm having a first end and a second end, said first end having a first means for connection to said main enclosure, said second end connected to said canopy so that said canopy can be adjusted; and g) an antenna for said means for an audio module, said antenna disposed in said adjustable arm.

2. The apparatus of claim 1, further comprising at least one hook disposed on said main enclosure for attachment to a back rest of a lawn chair.

3. The apparatus of claim 2, further comprising means for attaching said at least one hook to said main enclosure.

4. The apparatus of claim 3, wherein said means for attaching further comprises adhesive.

5. The apparatus of claim 1, further comprising a protective cover disposed on said head rest.

6. The apparatus of claim 1, wherein said arm is extendable.

7. The apparatus of claim 1, wherein said arm is flexible.

8. The apparatus of claim 1, wherein one said aperture of said main enclosure receives said first means for connection of said first end of said adjustable arm.

9. The apparatus of claim 1, wherein said means for an audio module further comprises a radio.

10. The apparatus of claim 9, further comprising at least one audio speaker for said radio disposed in said main enclosure.

11. The apparatus of claim 10, wherein said at least one audio speaker is disposed internal one of said apertures of said main enclosure.

12. The apparatus of claim 10, further comprising a volume control for said radio and a station selector for said radio.

13. The apparatus of claim 12, wherein said volume control and said station selector are disposed internal one of said apertures of said main enclosure.

14. The apparatus of claim 10, further comprising a battery power supply for said radio.

15. The apparatus of claim 1, further comprising an end cap cover for said adjustable arm for protecting said antenna from foreign matter.

16. The apparatus of claim 1, further comprising a fan disposed on said canopy for cooling a user.

* * * * *